US005884757A

United States Patent [19]

Prince

[11] Patent Number: 5,884,757

[45] Date of Patent: Mar. 23, 1999

[54] EASY RELEASE BOTTLE CARRIER

[76] Inventor: John F. Prince, 6136 Crestview Dr., North Syracuse, N.Y. 13212

[21] Appl. No.: 918,801

[22] Filed: Aug. 26, 1997

[51] Int. Cl.[6] ..... B65D 75/00

[52] U.S. Cl. ..... 206/153; 206/158; 206/427

[58] Field of Search ..... 206/145, 147, 206/148, 149, 150, 151, 156, 157, 192, 199, 427, 153, 158

[56] References Cited

U.S. PATENT DOCUMENTS

| | | | |
|---|---|---|---|
| 2,472,005 | 5/1949 | De Swart . | |
| 3,331,500 | 7/1967 | Poupitch . | |
| 4,318,476 | 3/1982 | Wood et al. | 206/158 |
| 4,518,081 | 5/1985 | de Larosiere | 206/158 |
| 4,523,677 | 6/1985 | Schurmann . | |
| 5,311,994 | 5/1994 | Oliff . | |
| 5,314,224 | 5/1994 | Bates . | |
| 5,443,298 | 8/1995 | Finley . | |
| 5,487,464 | 1/1996 | Galbierz et al. . | |
| 5,590,776 | 1/1997 | Galbierz et al. . | |
| 5,595,292 | 1/1997 | Bates | 206/158 |

*Primary Examiner*—Jacob K. Ackun
*Attorney, Agent, or Firm*—Wall Marjama Bilinski & Burr

[57] ABSTRACT

A beverage-containing article carrier includes a supporting frame and a release strip member. The supporting frame member contains a first set of openings having a diameter which is larger than the necked portion of bottles retained in the carrier. The release strip is releasable relative to the supporting frame and covers a portion of the first openings. The release strip further includes a plurality of arc-like recess portions, which combines to form with the uncovered portions of the first openings, a set of second openings having a diameter sized to retain the necked portion of a beverage-containing article, such as a bottle or can. Preferably, the second openings each include a set of retaining tabs, whereby removal of the release strip causes at least one of the tabs to be removed, allowing a predetermined number of articles to drop through the first openings.

6 Claims, 3 Drawing Sheets

EASY RELEASE BOTTLE CARRIER

FIELD OF THE INVENTION

The invention relates to beverage carriers, such as for bottles or cans, and more specifically to a carrier having a unique releasable strip portion to allow selective release of one or more articles from the carrier.

BACKGROUND OF THE INVENTION

Currently, there are known carriers for retaining a predetermined number of containers, such as bottles or cans or others used for containing carbonated beverages, e.g., soda-pop, water, etc.

The most common bottle carrier is the so-called "basket carrier" which, as the name denotes, is formed into a basket which receives a predetermined number of bottles. Six packs of soda and beer are often seen using such basket carriers. These carriers have several drawbacks. First, the blanks for the carriers are complex, requiring equally complex machinery for their construction. In addition, filling the bottles using these carriers is also tedious and time-consuming. Finally, these basket carriers are difficult to stack, such as for display in a store.

To that end, bottle carriers have been developed which include a plurality of neck-receiving apertures. Typically, the apertures include a number of radially extending tabs projecting from the circumferential margin of the aperture which engage the chime or the crown of the bottle to hold the bottle in the carrier. To remove the bottles from the carrier, the bottles must be individually pulled downwardly through the tabs. The force required, however, to overcome the restraining force of the tabs is significant and difficult to overcome. It has been found that pivoting or hinging the bottle eases in the removal of the bottles, most notably, in plastic carriers of the type, but in removing a bottle as described the structural integrity of the carrier may be compromised or in other instances, other bottles may be inadvertently released, either agitating the contents or breaking the bottles.

To solve the above problems, some carriers introduced release mechanisms. U.S. Pat. No. 5,487,464 issued to Galbierz et al. and filed Jul. 29, 1994 describes a paperboard carrier having individual tear strips which expand the bottle neck apertures. A tear-strip can release mechanism is described by U.S. Pat. No. 3,331,500 to Poupitch. Another Galbierz et al. patent U.S. Pat. No. 5,590,776 filed Oct. 6, 1995, describes a paperboard carrier using a perforated strip which removes a first ply of material and expands openings to facilitate removal of bottles from the carrier. In this particular mechanism, the second ply includes the entirety of the tabs as well as a series of release openings such that removal of the first ply expands the bottle neck opening allowing the bottle to break through a slit forming a tab and allow the bottle to pass to the release opening. Such a mechanism as described is complex and difficult to manufacture. Moreover, such a design is not equally suitable for plastic bottle holders, which are becoming increasingly popular due to their ease in molding and ability to mass-produce.

SUMMARY OF THE INVENTION

It is therefore a primary object of the present invention to improve the state of the art of beverage carriers.

It is another primary object of the present invention to provide a carrier which allows selective removal of any number of retained bottles, cans, or other beverage containing articles without sacrificing the integrity of support for any articles still retained within the carrier.

It is another primary object of the present invention to provide a carrier which can be manufactured in parallel with currently plastic-molded or otherwise mass-produced carriers, with little or almost no modification thereto.

Therefore, and in accordance with a preferred aspect of the present invention, there is provided a carrier for retaining a predetermined number of beverage containing articles, said articles each having a necked portion, said carrier comprising a supporting frame including a plurality of first openings, each opening having a diameter which is larger than the diameter of said necked portion; and a release strip member releasably attached to said supporting frame, said strip member including a plurality of arc segments, each segment being aligned with a portion of a corresponding first opening of said supporting frame to define a plurality of second openings, said second opening each having a diameter sized to retain said necked portion, wherein said arc segments and at least a portion of said first openings include a plurality of inwardly directed tabs, in which removal of said strip causes removal of at least one tab from at least one second opening, allowing release of at least one said beverage containing article from said carrier.

According to another preferred aspect of the present invention, there is provided a carrier for retaining a predetermined number of beverage-containing articles, each of said articles having a necked portion, said carrier comprising a supporting frame including a plurality of first openings, each opening having a diameter which is larger than the diameter of said necked portion; and a releasable strip member releasably secured to said supporting frame, said strip member including a planar section having a plurality of spaced recesses on a border thereof, said planar section of said strip member covering a first portion of said first openings, said recesses being aligned with a second portion of said first opening to form a plurality of corresponding circular second openings, each said second opening having a diameter sized to retain the necked portion of a said beverage-containing article, and in which removal of said strip member causes release of at least one beverage-containing article from the carrier.

Preferably, each of the openings include a number of radial inwardly extending tabs as provided by each of the top portion of the supporting frame member and the releasable strip member which combine to form a circumferential arrangement. When the releasable strip portion is detached or pulled away from the top portion, a portion of the tabs are also pulled away, thereby expanding the opening and allowing a selected beverage-containing article, such as a bottle or can, to drop from the carrier without any pulling force required of the article itself. Still, more preferably, the supporting frame member includes a plurality of first openings which are larger than the size of a corresponding beverage-containing article's neck diameter and the releasable strip member includes a plurality of arc segments which effectively align with and combine with the first openings to define article retaining openings, the releasable strip member conforming to extend over the length of the supporting frame member and including end portions which can be pulled upwardly and across the length of the top portion to selectively remove any portion of the strip section.

Though the releasable strip member and the supporting frame member are made from a molded plastic, it is conceivable that other suitable materials, such as paperboard and the like, can be used.

According to yet another preferred aspect, there is provided a carrier for retaining a predetermined number of beverage-containing articles, each of said articles having a necked position including a circumferential lip, said carrier comprising a supporting frame including a planar top section forming a first ply and having a plurality of first openings, each opening having a diameter which is larger than the diameter of the circumferential lip of said necked portion, and a releasable strip member releasably bonded to said planar section, said strip member having a planar section defining a second ply, said planar section effectively covering a portion of said first openings and having a plurality of recessed areas on a border thereof to form a plurality of circular second openings with said uncovered portions of said first openings, each of said uncovered portions and said recesses including retaining tabs extending inwardly from the defined inner circumference of each said second opening, said tabs forming a collar having a diameter which is smaller than the diameter of said circumferential lip to support a said beverage-containing article wherein removal of said strip causes a portion of said tabs to be removed to allow release of at least one said article from said carrier.

An advantage of the present invention is that a predetermined number of bottles, cans, or other beverage containers, can be suitably supported and any number thereof can be individually or otherwise removed in a contemporaneous manner with less force than typically required using known carriers of similar type.

Another advantage of the present invention is that the described carrier can be manufactured using known techniques, and with only minor modifications to already existing dies.

Still another advantage of the present invention is that the described carrier allows more than one beverage-containing article or a selective number of articles, while allowing the remaining articles to be supported without compromise to the structural integrity of the carrier.

These and other objects, features, and advantages will herein be described in accordance with the following Detailed Description of the Invention as read in conjunction with the accompanying drawings.

DETAILED DESCRIPTION OF THE INVENTION

The following description relates to a preferred embodiment of a specific bottle carrier in accordance with the present invention. Throughout the course of discussion, a number of terms such as "top", "bottom", "side", "lateral", "upper", "lower", "upwardly", and "downwardly" are used. These terms are used to provide a frame of reference with regard to the accompanying drawings, and are not intended to be limiting of the claimed invention. In addition, the following description relates to a bottle carrier for retaining plastic bottles. It will be readily apparent from the discussion which follows that other beverage-containing articles, such as cans, can be employed using a carrier as taught according to the present invention.

Figure 1:
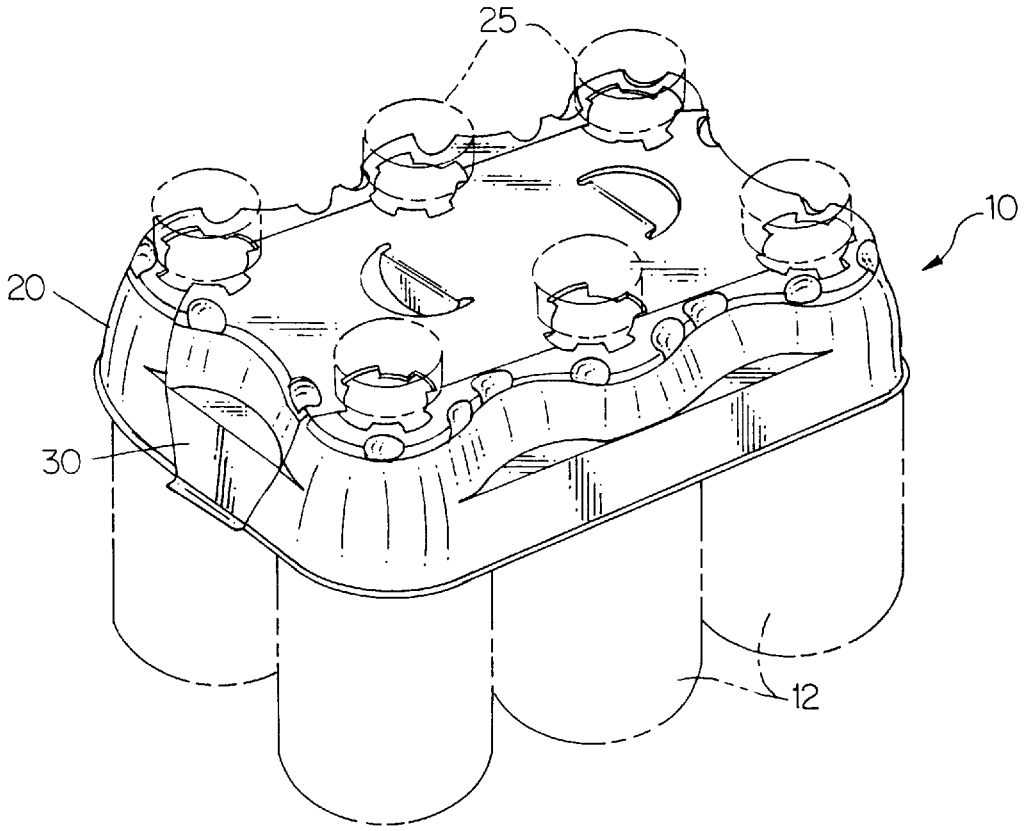
FIG. 1 is a front perspective view of a beverage-containing article carrier in accordance with a preferred embodiment of the present invention.
Figure 3:
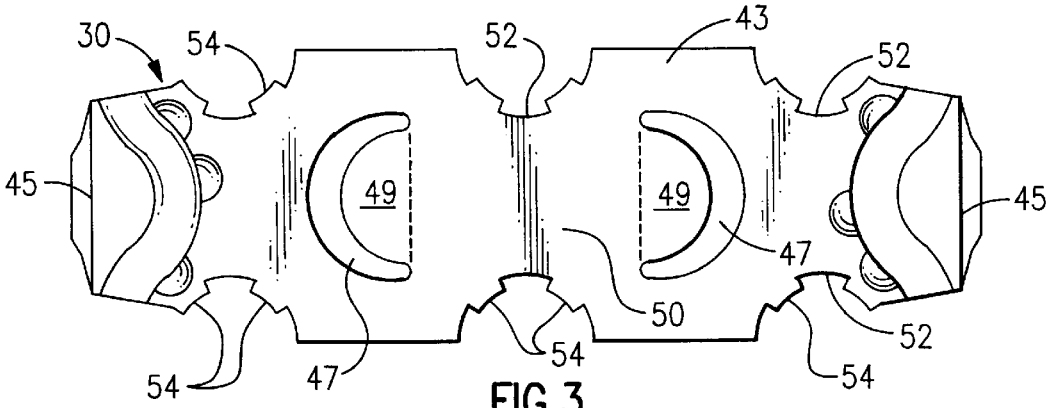
FIG. 3 is a top view of a releasable strip member according to one embodiment for use with the supporting frame member of FIG. 1.
Figure 4:
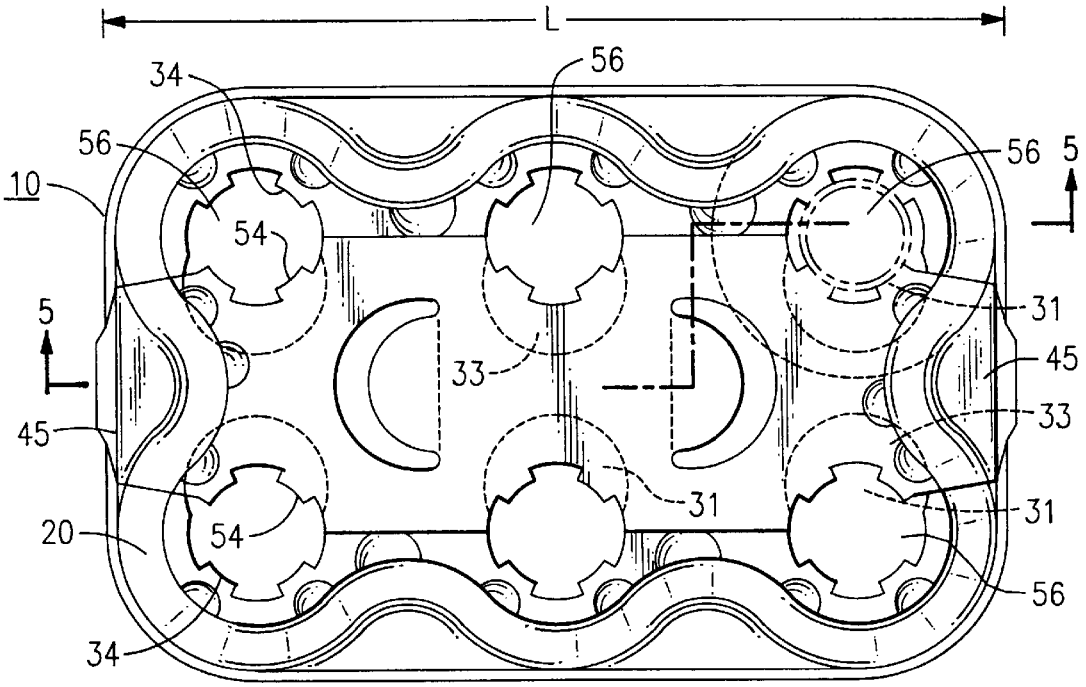
FIG. 4 is a top view of the assembled carrier of FIG. 1, indicating the relative positions, of the frame and releasable strip members of FIGS. 1 and 2.
Figure 5:
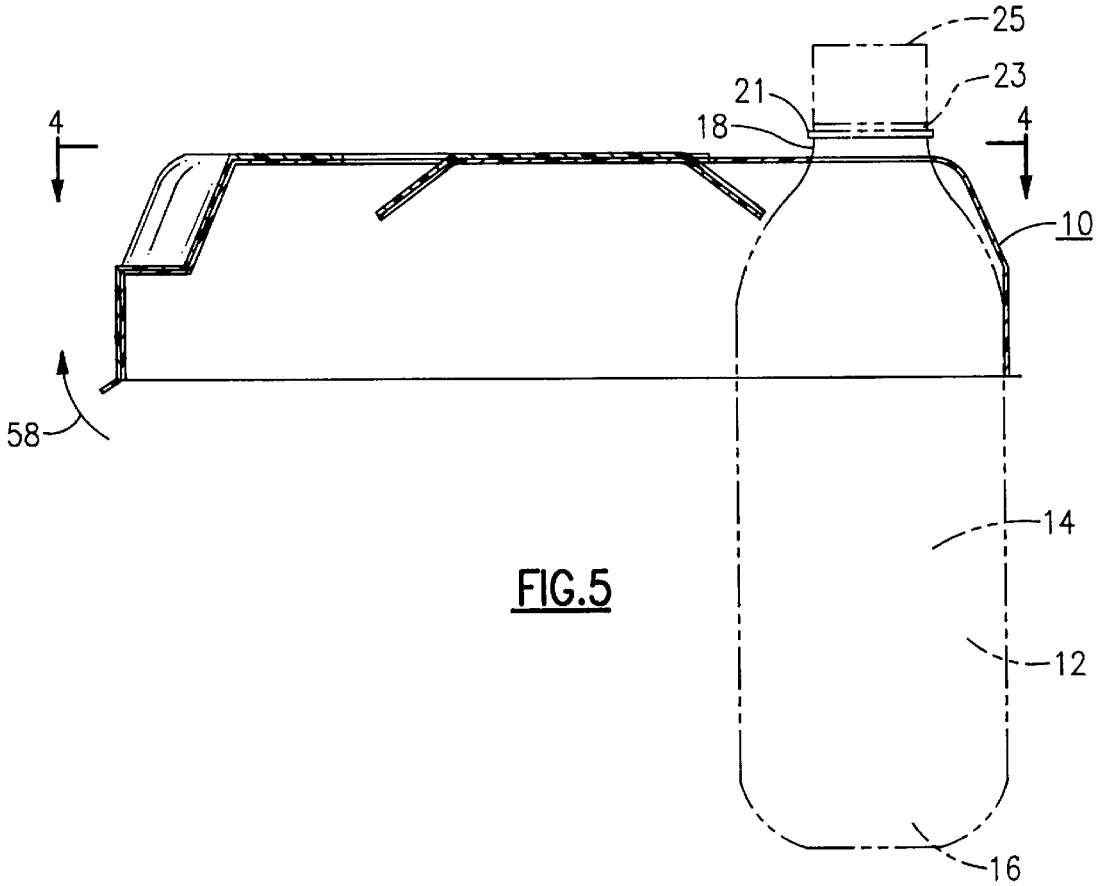
FIG. 5 is a sectional view of the carrier, as taken through lines 5—5 of FIG. 4, illustrating the restraint of a typical beverage-containing article retained therein.

Referring to FIGS. 1–6, and more specifically to FIGS. 1 and 5, there is provided a bottle carrier 10 according to a preferred embodiment sized for retaining a corresponding number of bottles 12, such as used for containing carbonated or uncarbonated beverages or juices. As shown in FIG. 5, the bottles 12 are typically made from glass, or alternately from molded plastics, such as PET or PVC. Each bottle 12 of the present embodiment is defined by a molded body 14 defining a fluid retaining volume typically sized to contain 12, 16, 20 or 32 fluid ounces, the body including a circular base 16 at a lower or bottom end and a neck 18 at the opposite or upper end of the body. The neck 18 preferably includes a molded circumferential lip 21 above which is located a threaded portion 23 for allowing engagement therewith by a similarly threaded screw top 25. The base 16, as noted, is circular in shape and allows the bottle 12 to stand independently on a planar surface (not shown). The described bottles 12 are typically formed from a blow-molding process, the details of which are commonly known and which do not form an essential part of the present invention. As will be apparent from the following description, other bottle forms, such as glass, or metal in the case of other beverage-containing articles, such as cans, can also easily be supported by the described bottle carrier.

Referring back to FIG. 1, the bottle carrier 10 according to this embodiment retains six (6) of the described bottles 12, shown in phantom, though it will be appreciated that designs embodying the concepts taught herein could easily be varied to handle a greater or fewer number of bottles.

Figure 2:
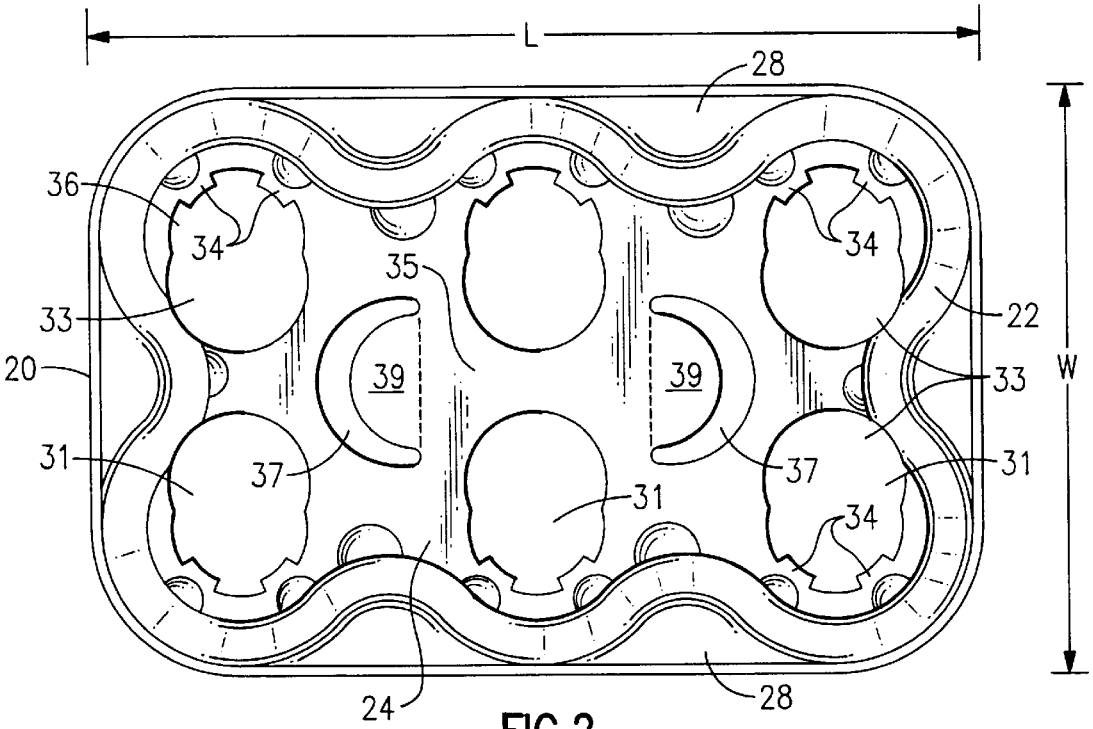
FIG. 2 is a top -view of the supporting frame member of the carrier of FIG. 1.

Referring to FIGS. 1–3, the bottle carrier 10 of the present embodiment is a unique two-piece construction, including a supporting frame member 20 and a releasable strip member 30. The supporting frame member 20 is generally defined by a plastic molded body section 22 having a substantially planar top portion 24 and depending side portions 26 which combine to form a rectangular skirt-like structure. The body 22 includes a major or length dimension (-L-) and a minor or width dimension (-W-), and is defined by a generally uniform thickness. According to this embodiment, the carrier member 20 is approximately 0.020 inches (5 mm) thick.

The top portion 24 of the supporting frame member 20 also includes a plurality of retaining pockets 28, each projecting downwardly to form a series of cavities for loosely surrounding the upper end of a retained bottle body 14. A pair of evenly spaced pockets 28 are provided along each side of the major dimension of the frame section 22, while one pocket is provided at each remaining end to thereby form six retaining cavities 29. The cavities 29 project inwardly from the top portion 24 to approximately one half of the overall height of the support frame member 20, though this parameter can easily be varied. In addition, the corners of the body 22 are curved so as to define cavities sized for loosely containing a bottle 12 therein. The above features of the supporting frame member 20 are commonly known to several existing bottle carriers and require no further discussion, except as needed, to describe the present invention.

Referring now to FIG. 2, the top portion 24 of the body 22 includes a series of openings 31 spaced around the exterior thereof. According to this embodiment, four (4) of the openings 31 positioned on each of the four corners of the body 22, and two additional openings are evenly spaced between the corner openings along each side of the major dimension of the carrier member 30 to define a pair of parallel rows of openings. Each opening 31 includes a pair of overlapping substantially circular components 33, 36. The first or inboard circular component 33 has a diameter which is substantially equal to the bottle lip diameter, while the second or outboard circular component 36 includes at least one inwardly extending radial tab 34 extending from the circumferential margin on the outboard side thereof, outboard referring to a relative position from the center of the carrier. According to the preferred embodiment a pair of radial tabs 34 are provided.

The support frame member 20 also includes a handle section 35 for allowing the bottle carrier 10 to be lifted from the planar surface (not shown) for transporting. The handle section 35 includes a pair of semicircular openings 37, each opening having a crescent-shaped hingeable or gripping tab 39 evenly spaced from the center of the top portion 24. The openings 37 are spaced a convenient distance (approximately 3 inches (7.7 cm) from each other, allowing a user to place a thumb and a finger from one hand to allow handling of the bottle carrier 10. Handle portions, as described, are commonly known and do not necessarily form an essential part of the present invention, except as indicated. Before going forward to describe the function of the openings 31 and the tabs 34, it is first necessary to describe the releasable strip member 30 in greater detail.

Referring to FIG. 3, the releasable strip member 30 includes a top portion 43 and a pair of end portions 45 depending therefrom. The top portion 43 corresponds in length to the major dimension of the top portion 24 of the supporting frame member 20. Like the supporting frame member 20, the releasable strip member 30 is also preferably formed from a single section of a molded plastic material, and is defined by a substantially uniform thickness. According to this embodiment, the releasable strip member is approximately 5 mm (0.020 inches) thick. Like the top portion 24 of the carrier member 20, the top portion 43 of the releasable strip member 30 also includes a handle portion 50 including a pair of center openings 47 corresponding, when assembled thereto, to the openings of the handle portion 35 of the carrier member as to size and spacing and including respective gripping tabs 49. The releasable strip member 30 also includes a plurality of evenly spaced circular arc-like segments 52, each defined along the exterior of the periphery of the strip, and including at least one inwardly projecting and radially spaced tab 54, projecting inwardly from the circumferential margin by a distance approximately equal to the radius of the bottle lip. According to this embodiment, a pair of tabs 54 are provided though this number can be varied.

Referring to FIG. 4, the relative locations of the releasable strip member 30 and the supporting frame member 20 in an assembled carrier are illustrated. As is clear, the top portion 43 of the releasable strip member 30 has the same length dimension as the top portion 24 of the supporting frame member 20 with the depending end portions 45 extending over the exterior of the frame section 22. The handle section 50 of the releasable strip member 30 and the handle portion 35 of the supporting frame member 20, provide an overall reinforced section.

Figure 6:
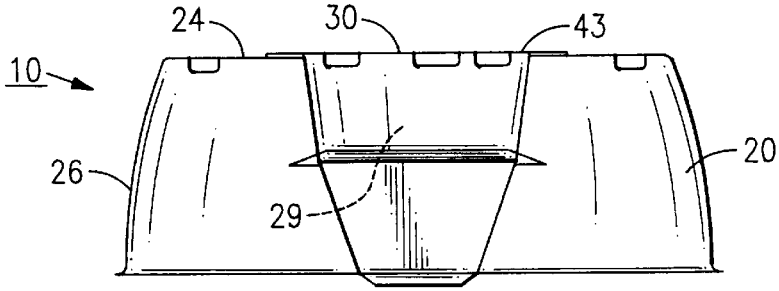
FIG. 6 is an end elevational view of the carrier of FIGS. 1–5.

More importantly, with respect to the present invention, the arc-like segments 52 of the releasable strip member 30 combine with the openings 31 of the supporting frame member 20 to form an overall circular opening 56 in which the tabs 54 of the releasable strip portion 30 and the tabs 34 of the supporting frame member 20 define a continuous circumferential arrangement, having a diameter which is sized to retain the diameter of the bottle lip 21. As shown in FIGS. 5 and 6, the inwardly extending tabs 34 define a supporting platform for the bottles 12.

In use, and referring to the Figs. in general, the above described bottle carrier 10 retains each of the bottles 12 within the side walls of the frame section 22 of the carrier member 20, each of the bottles being retained by the equally spaced and radially disposed locking tabs 34, 54, which are sized to allow the bottle neck 18 but not the circumferential lip 21 to pass therethrough, as shown by the arrow 58.

The releasable strip member 30 according to this embodiment formed in a known manner with the carrier member 20 to allow releasability and can be engaged by a user at either end 45. By pulling vertically upwardly upon the tab 38 which is hingeably connected thereto, the strip member 30 is pulled from the top portion 24 of the supporting frame member 20. As the end 45 of the releasable strip member 30 is pulled away from the side 26 and top portions 24 of the carrier member 20, the arc-shaped section 52 and corresponding locking tabs 54 are also pulled away from the opening 31 thereby increasing the size of the opening and allowing the lip of the neck 18 of the bottle 12 to pass therethrough, through the circular component 33. As such, none of the remaining bottles 12 are disturbed and the structural intensity of the bottle carrier 10 is maintained.

The remaining bottles 12 remain supported by the carrier 10 until the strip member 30 is pulled to remove the supporting tabs 54 forming the retaining opening 56. Removal of the strip member 30 necessarily pulls the retaining tabs 54 and the arc-like segment 52 from each opening 56, and removes the ply which covers the opening 31, allowing the bottles to drop through the circular component 33 selectively depending on the portion of the strip member removed from the carrier 10. That is, either one, several, or all of the bottles can be removed from the described carrier 10 in this manner.

PARTS LIST FOR FIGS. 1–6

| | |
|---|---|
| 10 | bottle carrier |
| 12 | bottle |
| 14 | body |
| 16 | base |
| 18 | circumferential neck |
| 20 | supporting frame member |
| 22 | frame section |
| 24 | top portion |
| 25 | screw top |
| 26 | side portions |
| 28 | molded retaining pockets |
| 29 | cavities |
| 30 | releasable strip member |
| 31 | openings |
| 33 | circular component |
| 34 | tab |
| 36 | circular component |
| 37 | semi-circular openings |
| 39 | hingeable gripping tab |
| 43 | top portion |
| 45 | end portions |
| 47 | semi-circular openings |
| 49 | gripping tabs |
| 50 | handle portion |
| 52 | circular-arc-like segments |
| 54 | tabs |

-continued

| PARTS LIST FOR FIGS. 1–6 |
| --- |
| 56 circular opening |
| 58 arrow |

Though the preceding description related to a specific embodiment of the present invention, it will be readily apparent that other modifications and changes can easily be imagined by those of ordinary skill in the field, embodying the concepts as presently claimed.

What is claimed is:

1. A beverage carrier comprising:

a supporting frame having a top layer including a plurality of spaced first openings; and a release strip member releasably attached to said top layer of said supporting frame and covering a portion thereof, said strip member including a plurality of substantially semi-circular portions aligned with said spaced first openings to define a plurality of circular second openings wherein each of said semi-circular portions and the corresponding portion of said first opening forming each said second opening include a plurality of support tabs having a diameter sized to retain the chime of a supported beverage-containing article and in which removal of a portion of said support tabs allowing one or more beverage-containing articles to be released from the carrier through said first openings.

2. The beverage carrier of claim 1, wherein said supporting frame and said release strip member are molded plastic.

3. The beverage carrier of claim 1, wherein said top layer forms a first ply and said release strip member forms a second ply, wherein said second openings are defined by both plies.

4. The beverage carrier of claim 1, wherein said first openings are each defined by a pair of overlapping circular segments forming an elongated opening.

5. The beverage carrier of claim 4, wherein each of said overlapping circular segments include a diameter which is larger than the chime of a beverage-containing article.

6. A beverage carrier comprising:

a supporting frame having a top layer including a plurality of spaced first openings; and a release strip member releasably attached to said top layer of said supporting frame and covering a portion thereof, said strip member including a plurality of substantially semi-circular portions aligned with said spaced first openings to define a plurality of circular support openings having a plurality of support tabs having a diameter sized to engage the chime of a beverage-containing article wherein removal of said strip member causes the removal of a portion of said support tabs from one or more second openings and allow the release of at least two beverage containing articles through said first openings.

* * * * *